US008316644B2

(12) United States Patent
Wilbraham

(10) Patent No.: US 8,316,644 B2
(45) Date of Patent: Nov. 27, 2012

(54) BURNER HAVING SWIRLER WITH CORRUGATED DOWNSTREAM WALL SECTIONS

(75) Inventor: Nigel Wilbraham, Stourbridge (GB)

(73) Assignee: Siemens Aktiengesellschaft, München (DE)

( * ) Notice: Subject to any disclaimer, the term of this patent is extended or adjusted under 35 U.S.C. 154(b) by 910 days.

(21) Appl. No.: 12/227,583

(22) PCT Filed: Feb. 27, 2007

(86) PCT No.: PCT/EP2007/051825

§ 371 (c)(1),
(2), (4) Date: Apr. 1, 2009

(87) PCT Pub. No.: WO2007/144209

PCT Pub. Date: Dec. 21, 2007

(65) Prior Publication Data

US 2009/0272117 A1 Nov. 5, 2009

(30) Foreign Application Priority Data

Jun. 12, 2006 (EP) ..... 06012058

(51) Int. Cl.
*F02C 1/00* (2006.01)
*F02G 3/00* (2006.01)
*B05B 7/10* (2006.01)

(52) U.S. Cl. ..... 60/748; 60/740; 60/742; 60/746; 60/747; 60/737; 239/399

(58) Field of Classification Search ..... 60/748, 60/740, 742, 746, 747, 737; 239/399
See application file for complete search history.

(56) References Cited

U.S. PATENT DOCUMENTS

| | | | | |
|---|---|---|---|---|
| 5,251,447 | A | | 10/1993 | Joshi et al. |
| 6,050,096 | A | * | 4/2000 | Senior ..... 60/748 |
| 6,094,916 | A | * | 8/2000 | Puri et al. ..... 60/737 |
| 6,141,967 | A | | 11/2000 | Angel et al. |
| 6,253,555 | B1 | | 7/2001 | Willis |
| 6,513,329 | B1 | | 2/2003 | Snyder et al. |
| 2001/0052229 | A1 | | 12/2001 | Tuthill et al. |

FOREIGN PATENT DOCUMENTS

| | | | |
|---|---|---|---|
| EP | 0870989 | A2 | 10/1998 |
| EP | 0982545 | A2 | 3/2000 |
| GB | 2305498 | A | 4/1997 |
| GB | 2332509 | A | 6/1999 |

* cited by examiner

*Primary Examiner* — William H Rodriguez
*Assistant Examiner* — Carlos A Rivera

(57) ABSTRACT

The invention relates to a burner, in particular a gas turbine burner, comprises: at least one swirler, the swirler having at least one air inlet opening, at least one air outlet opening positioned downstream to the air inlet opening and at least one swirler air passage extending from the at least one air inlet opening to the at least one air outlet opening which is delimited by swirler air passage walls, the air passage walls comprising downstream wall sections adjoining the at least one air outlet opening; and a fuel injection system which comprises fuel injection openings arranged in at least one swirler air passage wall so as to inject fuel into the swirler air passage; in which at least the downstream section of one air passage wall is corrugated.

9 Claims, 3 Drawing Sheets

BURNER HAVING SWIRLER WITH CORRUGATED DOWNSTREAM WALL SECTIONS

CROSS REFERENCE TO RELATED APPLICATIONS

This application is the US National Stage of International Application No. PCT/EP2007/051825, filed Feb. 27, 2007 and claims the benefit thereof. The International Application claims the benefits of European application No. 06012058.1, filed Jun. 12, 2006, both of the applications are incorporated by reference herein in their entirety.

FIELD OF THE INVENTION

The present invention relates to a burner, in particular to a gas turbine burner, having an air inlet duct and at least one swirler disposed in said air inlet duct.

BACKGROUND OF THE INVENTION

In a gas turbine burner a fuel is burned to produce hot pressurised exhaust gases which are then led to a turbine stage where they, while expanding and cooling, transfer momentum to turbine blades thereby imposing a rotational movement on a turbine rotor. Mechanical power of the turbine rotor can then be used to drive a generator for producing electrical power or to drive a machine. However, burning the fuel leads to a number of undesired pollutants in the exhaust gas which can cause damage to the environment. Therefore, it takes considerable effort to keep the pollutants as low as possible. One kind of pollutant is nitrous oxide ($NO_x$). The rate of formation of nitrous oxide depends exponentially on the temperature of the combustion flame. It is therefore attempted to reduce the temperature over the combustion flame in order to keep the formation of nitrous oxide as low as possible.

There are two main measures by which reduction of the temperature of the combustion flame is achievable. The first is to use a lean stoichiometry, e.g. a fuel/air mixture with a low fuel fraction. The relatively small fraction of fuel leads to a combustion flame with a low temperature. The second measure is to provide a thorough mixing of fuel and air before the combustion takes place. The better the mixing is the more uniformly distributed is the fuel in the combustion zone. This helps to prevent hotspots in the combustion zone which would arise from local maxima in the fuel/air mixing ratio.

Modern gas turbine engines therefore use the concept of premixing air and fuel in lean stoichiometry before the combustion of the fuel/air mixture. Usually the pre-mixing takes place by injecting fuel into an air stream in a swirling zone of a combustor which is located upstream from the combustion zone. The swirling leads to a mixing of fuel and air before the mixture enters the combustion zone.

U.S. Pat. No. 6,513,329 B1 describes a premixing of fuel and air in a mixing chamber of a combustor. The mixing chamber extends along, and is at least partly wound around, a longitudinal axis of the burner. Two rows of fuel injection passages are located in the outer wall of the mixing chamber axis. The outlet opening of the mixing chamber is formed by slots extending parallel to the longitudinal burner axis. By this construction, the fuel/air mixture leaving the mixing chamber has, in addition to an axial streaming component with respect to the burner axis, a radial streaming component.

US 2001/0052229 A1 describes a burner with uniform fuel/air premixing for low emissions combustion. The burner comprises an air inlet duct and a swirler disposed in the air inlet duct. The swirler comprises swirler vanes with primary and secondary gas passages and corresponding gas inlet openings. Fuel flow through the two gas passages to the inlet openings is controlled independently, and enables control over the radial fuel/air concentration distribution profile from the swirler hub to the swirler trough. The secondary gas inlet openings are located downstream from the primary gas inlet openings.

SUMMARY OF THE INVENTION

With respect to the mentioned state of the art it is an objective of the invention to provide a burner, in particular a gas turbine burner, enabling fine tuning of fuel/air mixing so as to provide a homogenous fuel/air mixture.

This objective is solved by a burner according to the independent claim. The dependent claims describe advantageous developments of the invention.

An inventive burner comprises an air inlet duct and at least one swirler disposed in said air inlet duct. The swirler has at least one air inlet opening, at least one air outlet opening positioned downstream from the air inlet opening relative to the streaming direction of the air passing through the air inlet duct and at least one swirler air passage extending from the at least one air inlet opening to the at least one air outlet opening. The swirler is delimited by swirler air passage walls which can be formed by a wall of the air inlet duct and/or swirler vanes. In addition, the inventive burner comprises a fuel injection system. The fuel injection system, which can generally be adapted for injection of gaseous or liquid fuels, comprises fuel injection openings, for example nozzles, which are arranged in at least one swirler air passage wall so as to inject fuel into the swirler air passage. At least the downstream section of one air passage wall is corrugated.

By such a design of the downstream section of the air passage wall a controlled fuel placement at the exit of the air passage is obtained. Thereby, a fine tuning of fuel/air mixing for improved $NO_x$ emissions is enabled. Especially, a better distribution of the injected fuel can be achieved in the swirler air passage. In addition, the homogeneity of the fuel/air mixture at the downstream end of the swirler air passage can be increased.

In a particular realisation of the burner, the air passage wall of a swirler vane has a lobed profile being complementary to that of the neighbouring air passage wall of the neighbouring swirler vane. Thereby, the fuel/air mixture can be directed in a pre-determined direction and pre-determined turbulences can be generated.

It is particularly advantageous when at least one first fuel injection opening is arranged at an upstream section of the swirler vane which adjoins the air inlet opening. This allows for a long mixing path in the air passage. The opening can be a nozzle.

In a further advantageous embodiment of the inventive burner at least one second fuel injection opening is arranged in a swirler support. The opening can be a nozzle. By such arrangement turbulences with air instreaming in the swirler can be generated so as fuel mixes with air in an improved manner.

Advantageously, the swirler support has a circular shape and the at least one first fuel injection opening of a swirler air passage is positioned on a certain radius of the circular swirler support. Further, the at least one second opening of the air passage is located at least nearly on the same radius as the first fuel injection opening. By this distribution of openings the formation of turbulence, and as a consequence, the mixing of fuel and air can be optimised.

In a particular realisation of the inventive burner the air passage wall of each swirler vane are tapering off in the direction to a central opening in the swirler support.

In a further development of the inventive burner the at least one first fuel injection opening and the at least one second fuel injection opening are located near the air inlet opening. That is, the fuel injection openings are arranged near the upstream end of the swirler air passages, thus allowing an early mixing of fuel and air. Thereby, the fuel/air mixing is optimised.

The inventive burner can be used in a turbine engine, in particular in a gas turbine engine, or in a furnace. The inventive burner helps to reduce the fraction of nitrous oxide in the exhaust gases of the turbine engine or the furnace, respectively.

BRIEF DESCRIPTION OF THE DRAWINGS

Further features, properties and advantages of the present invention will become clear from the following description of embodiments of the invention in conjunction with the accompanying drawings.

DETAILED DESCRIPTION OF THE INVENTION

Figure 1:
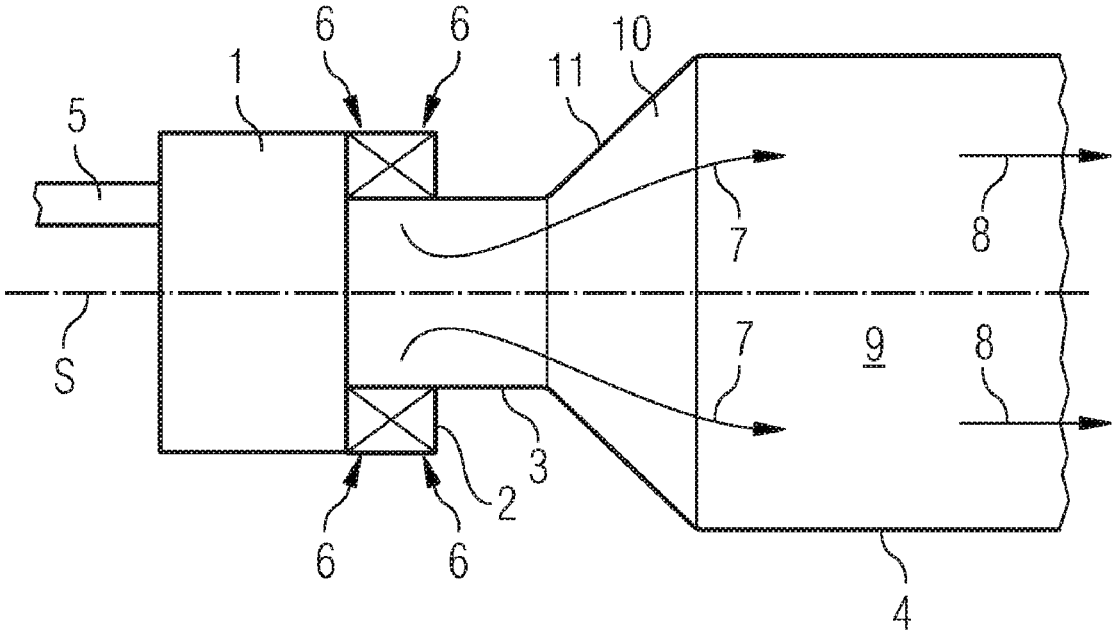
FIG. 1 shows a longitudinal section through a combustor.

FIG. 1 shows a longitudinal section through a combustor. The combustor comprises in flow direction series a burner with swirler portion 2 and a burner-head portion 1 attached to the swirler portion 2, a transition piece being referred as combustion pre-chamber 3 and a main combustion chamber 4. The main combustion chamber 4 has a diameter being larger than the diameter of the pre-chamber 3. The main combustion chamber 4 is connected to the pre-chamber 3 via a dome portion 10 comprising a dome plate 11. In general, the transition piece 3 may be implemented as a one part continuation of the burner 1 towards the combustion chamber 4, as a one part continuation of the combustion chamber 4 towards the burner 1, or as a separate part between the burner 1 and the combustion chamber 4. The burner and the combustion chamber assembly show rotational symmetry about a longitudinally symmetry axis S.

A fuel conduit 5 is provided for leading a gaseous or liquid fuel to the burner which is to be mixed with in-streaming air in the swirler 2. The fuel/air mixture 7 is then led towards the primary combustion zone 9 where it is burnt to form hot, pressurised exhaust gases streaming in a direction 8 indicated by arrows to a turbine of the gas turbine engine (not shown).

Figure 2:
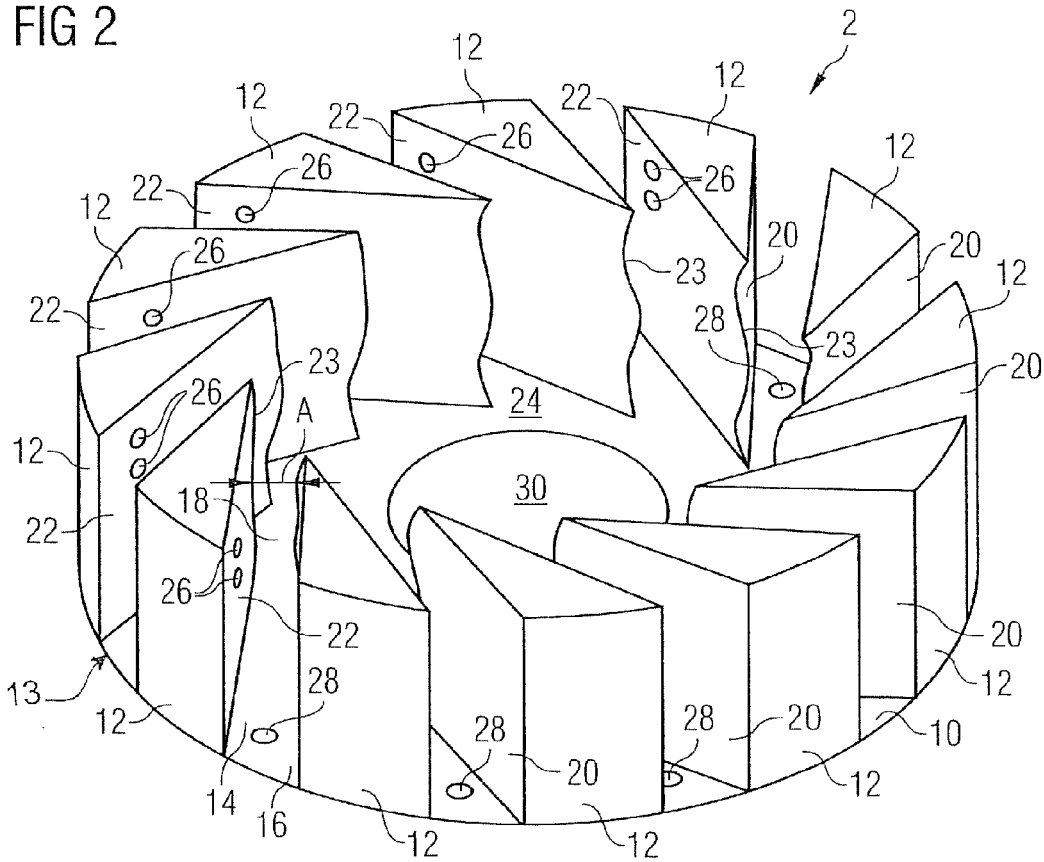
FIG. 2 shows a perspective view of an inventive swirler.

A swirler 2 according to the present invention is shown in detail in FIG. 2. It comprises twelve swirler vanes being arranged on a swirler vane support 13. The swirler vanes 12 can be fixed to the burner head (not shown) with their sides showing away from the swirler vane support 13.

Between neighbouring swirler vanes 12 air passages 14 are formed. The air passages 14 extend between an air inlet opening 16 and an air outlet opening 18. The air passages 14 are delimited by opposing side faces 20, 22 of neighbouring swirler vanes 12, by the surface 24 of the swirler vane support 13 which shows to the burner head (not shown) and by a surface of the burner head to which the swirler vanes 12 are fixed. The side faces 20, 22, the surfaces of the swirler vane support 13 and of the burner head form the air passage walls delimiting the air passages 14.

The side faces 20, 22 are corrugated in their downstream sections so as to form mixing lobes 23 on the swirler vanes 12. The corrugations of opposing side faces 20, 22 are complementary so as to lead to additional turbulence in the streaming fuel/air mixture and to a controlled fuel placement at the exit of the air passage.

Fuel injection openings 26 are arranged in the side faces 20. Further, fuel injection openings 28 are arranged in the swirler support 13. During operation of the burner, air flows into the air passages 14 through the air inlet openings 16. Within the air passages 14 fuel is injected into the streaming air by use of fuel injection openings 26, 28. The fuel/air mixture then leaves the air passages 14 through the air outlet openings 18 and streams through a central opening 30 of the swirler vane support 13 into the pre-chamber 3 (see FIG. 1). From the pre-chamber 3 it streams into the combustion zone 9 of the main chamber 4 where it is burned. As shown in FIG. 2, there are arranged two first fuel injection openings in the side faces 20 of the swirler vanes 12 so to define bottom and top first fuel injection openings 26.

Figure 3:
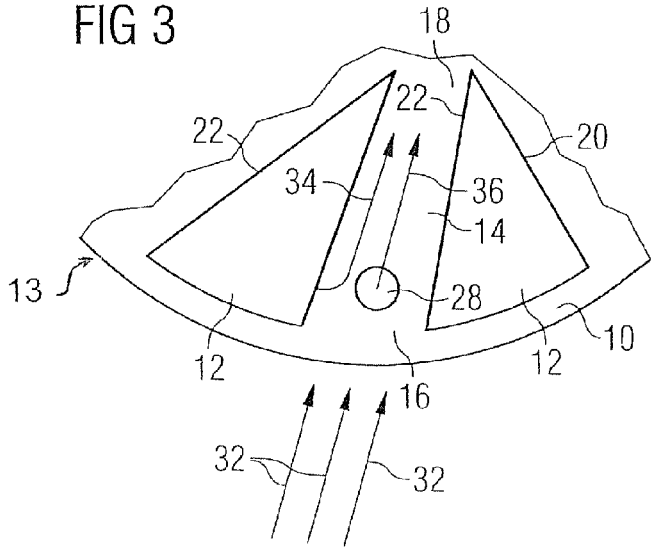
FIG. 3 shows a partial top view of the swirler shown in FIG. 2.

FIG. 3 shows a partial top view on two swirler vanes 12. The instreaming air is indicated by the arrows 32. Fuel is injected into the air passage 14 through the first fuel injection openings 26 (designated by arrow 34) and the second fuel injection openings 28 (designated by arrow 36) where it then streams together with the instreaming air 32. Due to the turbulences, a mixing of fuel and air takes place in the air passage 14.

A suitable configuration of the side faces 20, 22 together with a suitable placement of the fuel injection openings can be used to generate additional turbulence in the streaming fuel/air mixture and to control fuel mixing pattern at the exit of the air passage 14, and as a consequence to lower $NO_x$ emissions. Further, dynamics and noise control, especially for the fuel injected by 28, can be improved. The fuel mixing pattern is influenced by the lobed profile and the location of the fuel injection openings. Controlling the fuel placement by use of these parameters will be explained below.

Figure 4A:
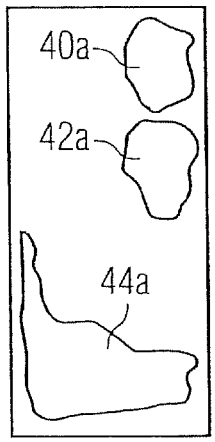
FIG. 4A schematically shows the distribution of fuel in the air stream through an air passage of the swirler for a state of the art burner in a section perpendicular to the streaming direction.

FIG. 4A schematically shows the distribution of fuel in the air stream through an air passage of the swirler for a state of the art burner where the downstream sections of the swirler vanes are not corrugated, in a section perpendicular to the streaming direction. The fuel placement 40 of the top first fuel injection opening 26 does not mix with the fuel placement 42*a* of the bottom first fuel injection opening 26, whereas the fuel placement 44*a* of the second fuel injection opening has a large distribution in the air flowing through the air passage.

Figure 4B:
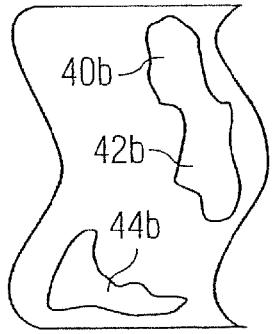
Prior Art FIG 4B
FIG. 4B schematically shows the fuel distribution according to FIG. 4*a* for an inventive burner in a first configuration.

FIG. 4B schematically shows the distribution of fuel in the air stream through an air passage 14 of the swirler 2 for an inventive burner in a first configuration which corresponds to the configuration shown in FIG. 2. The distribution is shown in a section perpendicular to the streaming direction. The fuel placement 40*b* of the top first fuel injection opening 26 mixes with the fuel placement 42*b* of the bottom first fuel injection opening 26. The fuel placement 44*b* of the second fuel injection opening 28 is less distributed in the air flowing through the air passage 14 than it is in FIG. 4A.

Figure 4C:
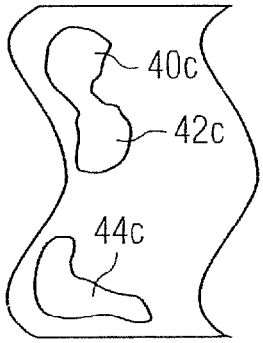
FIG. 4C schematically shows the fuel distribution according to FIG. 4*a* for an inventive burner in a second configuration.

FIG. 4C schematically shows the fuel distribution in the air stream through an air passage 14 of the swirler 2 for an inventive burner in a second configuration. The distribution is shown in a section perpendicular to the streaming direction. In contrast to the configuration of FIG. 4B, the fuel injection openings are located in the left-hand side face instead of the right-hand side face. Like in FIG. 4B, the fuel placement 40*c* of the top first fuel injection opening 26 mixes with the fuel placement 42*c* of the bottom first fuel injection opening 26, but on the left side of the air passage rather than on the right side. The mixed fuel placements do not migrate as far towards the bottom of the air passage as in FIG. 4B since the lobe obstructs such a migration. The fuel placement 44*c* of the second fuel injection opening 28 corresponds to that shown in FIG. 4B.

Figure 4D:
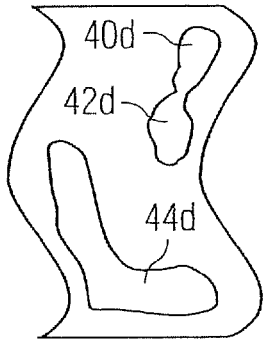
FIG. 4D schematically shows the fuel distribution according to FIG. 4*a* for an inventive burner in a third configuration.

FIG. 4D schematically shows the fuel distribution in the air stream through an air passage 14 of the swirler 2 for an inventive burner in a third configuration. The distribution is shown in a section perpendicular to the streaming direction. The lobe is swept to the right instead of the left. The fuel injection openings are located in the same side face as in FIG. 4B. Like in FIG. 4B, the fuel placement 40*d* of the top first fuel injection opening 26 mixes with the fuel placement 42*d* of the bottom first fuel injection opening 26. However, the mixed fuel placements 40*d*, 42*d* do not migrate as far towards the bottom of the air passage as they do in FIG. 4B, since the lobe obstructs such a migration. Further, the fuel placement 44*d* of the second fuel injection opening 28 migrates longer upwards on the left of the air passage than in FIG. 4B, since the lobe does not obstruct such a migration, as it does in FIG. 4B. The fuel placement 44*d* of the second fuel injection opening does not mix with the fuel placements 40*d*, 42*d* of the first fuel injection openings 26.

Figure 4E:
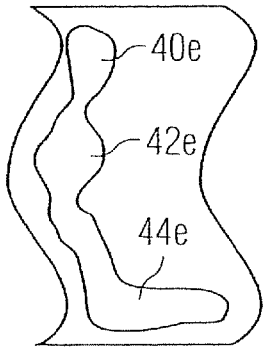
FIG. 4E schematically shows the fuel distribution according to FIG. 4*a* for an inventive burner in a fourth configuration.

FIG. 4E schematically shows the fuel distribution in the air stream through an air passage 14 of the swirler 2 for an inventive burner in a fourth configuration. The distribution is shown in a section perpendicular to the streaming direction. Like in FIG. 4D, the lobe is swept to the right instead of the left. The first fuel injection openings 26 are located in the left-hand side wall, like they are in FIG. 4C. The fuel placement 40*e* of the top first fuel injection opening 26 mixes with the fuel placement 42*e* of the bottom first fuel injection opening 26. In addition the mixture migrates further towards the bottom of the air passage than the mixture in FIG. 4C, since the lobe does not obstruct such a migration. Further, the fuel placement 44*e* of the second fuel injection opening 28 migrates longer upwards on the left of the air passage than in FIG. 4B as the lobe does not obstruct such a migration, as it does in FIGS. 4B and 4C. As a consequence, all fuel placements 40*e*, 42*e*, 44*e* merge to one.

It can be seen from the above that with varying the lobe and the location of the fuel injection openings the fuel placement at the exit of the air passage 14 can be strongly influenced. This increases the design opportunities for placing fuel into the burner.

Although the swirler of the present inventive embodiment has twelve swirler vanes and twelve swirler air passages, the invention may be implemented with a swirler having a different number of swirler vanes and swirler air passages. In addition, not only the locations of both the first and second fuel injection openings can vary but also the number of first and second fuel injection openings.

The first fuel injection openings in the described embodiment are located in one side face of a swirler vane. However, it is also possible to arrange the first fuel injection openings on both side faces of a swirler vane.

Although the corrugated air passage wall has only one lobe in the described embodiments, a higher number of lobes in the corrugated is air passage wall also possible.

The invention claimed is:

1. A burner, comprising:

a burner head;

a swirler comprising an air inlet opening and an air outlet opening positioned downstream of the air inlet opening;

a swirler vane support;

a plurality of swirler vanes arranged on the swirler vane support, a swirler air passage extending between neighbouring swirler vanes from the inlet opening to the outlet opening, the swirler air passage being delimited by swirler air passage walls, a surface of the swirler vane support and a surface of the burner head, the swirler air passage walls comprising corrugated downstream wall sections adjoining the air outlet opening; and a fuel injection system, comprising a first fuel injection opening arranged in one of the swirler air passage walls for injecting a fuel into the swirler air passage, and a second fuel injection opening arranged in the swirler vane support.

2. The burner as claimed in claim 1, wherein the swirler air passage walls comprise opposing side faces of neighbouring swirler vanes among the swirler vanes.

3. The burner as claimed in claim 2, wherein the opposing side faces of the neighbouring swirler vanes have corrugated profiles that are complementary to each other.

4. The burner as claimed in claim 1, wherein the fuel injection opening is arranged in an upstream section of the swirler vane that adjoins the air inlet opening.

5. The burner as claimed in claim 1, wherein the swirler support has a circular shape.

6. The burner as claimed in claim 1, wherein the first fuel injection opening is positioned on a radius of the swirler support and the second fuel injection opening is arranged nearly on the same radius of the swirler support.

7. The burner as claimed in claim 1, wherein the first fuel injection opening and the second fuel injection opening are located near the air inlet opening.

8. A turbine engine, comprising:

a burner according to claim 1.

9. A furnace, comprising:

a burner according to claim 1.

* * * * *